US009689396B2

(12) United States Patent
Branecky et al.

(10) Patent No.: US 9,689,396 B2
(45) Date of Patent: Jun. 27, 2017

(54) ENTRAPMENT DETECTION FOR VARIABLE SPEED PUMP SYSTEM USING LOAD COEFFICIENT

(71) Applicant: Regal Beloit EPC Inc., Beloit, WI (US)

(72) Inventors: Brian Thomas Branecky, Oconomowoc, WI (US); Yilcan Guzelgunler, Troy, OH (US)

(73) Assignee: Regal Beloit America, Inc., Beloit, WI (US)

( * ) Notice: Subject to any disclaimer, the term of this patent is extended or adjusted under 35 U.S.C. 154(b) by 504 days.

(21) Appl. No.: 13/663,525

(22) Filed: Oct. 30, 2012

(65) Prior Publication Data

US 2013/0108479 A1 May 2, 2013

Related U.S. Application Data

(60) Provisional application No. 61/554,215, filed on Nov. 1, 2011.

(51) Int. Cl.
*F04D 15/02* (2006.01)
*F04D 15/00* (2006.01)

(52) U.S. Cl.
CPC ..... *F04D 15/0236* (2013.01); *F04D 15/0077* (2013.01); *F04D 15/0088* (2013.01); *F04D 15/0094* (2013.01); *F04D 15/0218* (2013.01)

(58) Field of Classification Search
CPC .. F04D 15/02; F04D 15/0209; F04D 15/0218; F04D 15/0236; F04D 15/0254; F04D 15/0281; F04D 15/0077; F04D 15/0245; F04D 15/0088; F04D 15/0094; F04B 49/103; F04B 2201/1201;
(Continued)

(56) References Cited

U.S. PATENT DOCUMENTS 6,260,004 B1 7/2001 Hays et al.
6,715,996 B2 4/2004 Moeller
(Continued)

FOREIGN PATENT DOCUMENTS

EP 1072795 1/2001
EP 1072795 A1 1/2001
(Continued)

OTHER PUBLICATIONS

Search Report from the European Patent Office for Application No. 12190764.6 dated Feb. 5, 2015 (6 pages).
(Continued)

*Primary Examiner* — Bryan Lettman
*Assistant Examiner* — Timothy Solak
(74) *Attorney, Agent, or Firm* — Michael Best & Friedrich LLP

(57) ABSTRACT

Methods and systems for monitoring a variable-speed pump system to detect a blockage condition. A value indicative of pump performance is sensed and a pump load coefficient is calculated. The value of the pump load coefficient does not change substantially due to changes in pump speed and is indicative of a blockage of a drain in a liquid holding tank. A blockage of the drain is detected based at least in part on the calculated pump load coefficient and the operation of the pump is adjusted based on the detected blockage.

23 Claims, 5 Drawing Sheets

(58) Field of Classification Search
CPC ..... F04B 2201/1203; F04B 2203/02; F04B 2203/0208; F04B 2205/064; F04B 2205/09; F04B 2205/50
See application file for complete search history.

(56) References Cited

U.S. PATENT DOCUMENTS

| | | | | |
|---|---|---|---|---|
| 7,614,094 | B2 | 11/2009 | Wolfe | |
| 7,777,435 | B2 | 8/2010 | Aguilar et al. | |
| 2004/0090197 | A1* | 5/2004 | Schuchmann | 318/432 |
| 2006/0090255 | A1 | 5/2006 | Cohen | |
| 2007/0154320 | A1* | 7/2007 | Stiles et al. | 417/43 |
| 2007/0160480 | A1* | 7/2007 | Ruffo | 417/44.2 |
| 2007/0183902 | A1* | 8/2007 | Stiles et al. | 417/42 |
| 2008/0095640 | A1* | 4/2008 | Branecky | F04D 15/00 417/44.11 |
| 2008/0240931 | A1* | 10/2008 | Kallesoe | F04D 15/0236 417/44.11 |
| 2008/0288115 | A1* | 11/2008 | Rusnak et al. | 700/282 |
| 2009/0151801 | A1 | 6/2009 | Gorman et al. | |
| 2010/0092308 | A1 | 4/2010 | Stiles, Jr. et al. | |

FOREIGN PATENT DOCUMENTS

| | | | | |
|---|---|---|---|---|
| EP | 2196678 | 6/2010 | | |
| EP | 2196678 | A1 | 6/2010 | |
| FI | EP 2 196 678 | A9 * | 6/2010 | F04D 15/00 |

OTHER PUBLICATIONS

"Pentair IntelliFlo VS+SVRS Pool Pump" (product information page from Pentair Intelliflo website); Jun. 3, 2011; 1 pg.
European Search Report—Jan. 21, 2013; 6 pgs.
Search Report from the European Patent Office for Application No. 12190764.6 dated Sep. 29, 2015 (4 pages).

* cited by examiner

ENTRAPMENT DETECTION FOR VARIABLE SPEED PUMP SYSTEM USING LOAD COEFFICIENT

RELATED APPLICATIONS

The present patent application claims priority to U.S. Provisional Patent Application Ser. No. 61/554,215, filed on Nov. 1, 2011, the entire contents of which are herein incorporated by reference.

BACKGROUND

The present invention relates to systems and methods for detecting an entrapment event in a pool or spa pump system. An entrapment event occurs when an object covers at least a portion of the input to the pump system such as a drain in a pool. Entrapment events are monitored to detect potentially dangerous conditions where a person or animal may be trapped underneath the water in the pool or spa due to the suction of the drain. Pump systems also detect entrapment events to ensure that an obstruction does not negatively impact operation of the pump system.

SUMMARY

Systems that implement a single or two-speed pump motor are able to monitor for entrapment events by setting thresholds based on power. When the input to the pump system is obstructed, the power used by the system also decreases. However, in variable speed pump systems, the power varies as the speed of the pump changes. Therefore, a static threshold may not properly detect entrapment events.

In one embodiment, the invention provides a method for detecting an entrapment event in a variable-speed pump system based on a load coefficient that is independent of the speed of the pump motor. The system detects a body entrapment and automatically shuts off the motor. In some embodiments, the load coefficient is dependent upon the height of the pump above or below water level, the length and size of the pipe, the number of elbows and other restrictions in the pipe, and the number of valves. As such, variations in the pump coefficient indicate a degree to which the input to the pump system is obstructed independent of the speed of the pump motor.

In another embodiment, the invention includes a pump monitoring system comprising a controller. The controller is configured to receive a value indicative of pump performance. Based at least in part on this value, the controller calculates a pump load coefficient. The pump load coefficient is calculated such that its value does not change substantially due to changes in pump speed. Instead, the value of the pump load coefficient is more indicative of a blockage of a drain in a liquid holding tank such as a pool. The controller is further configured to detect a blockage of a drain based at least in part on the calculated pump load coefficient and adjusts the operation of the pump based on the detected blockage.

In some embodiments, the pump load coefficient $K_{lc}$ is calculated based on the equation: $K_{lc}=P/V^3$ where P is a value indicative of motor power of the pump and V is a value indicative of water velocity. In some embodiments, the calculation is the same, but V is a value indicative of motor speed.

In another embodiment, the invention provides a method of monitoring a pump for a blockage condition. A value indicative of pump performance is sensed and a pump load coefficient is calculated. The value of the pump load coefficient does not change substantially due to changes in pump speed and is indicative of a blockage of a drain in a liquid holding tank. A blockage of the drain is detected based at least in part on the calculated pump load coefficient and the operation of the pump is adjusted based on the detected blockage.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
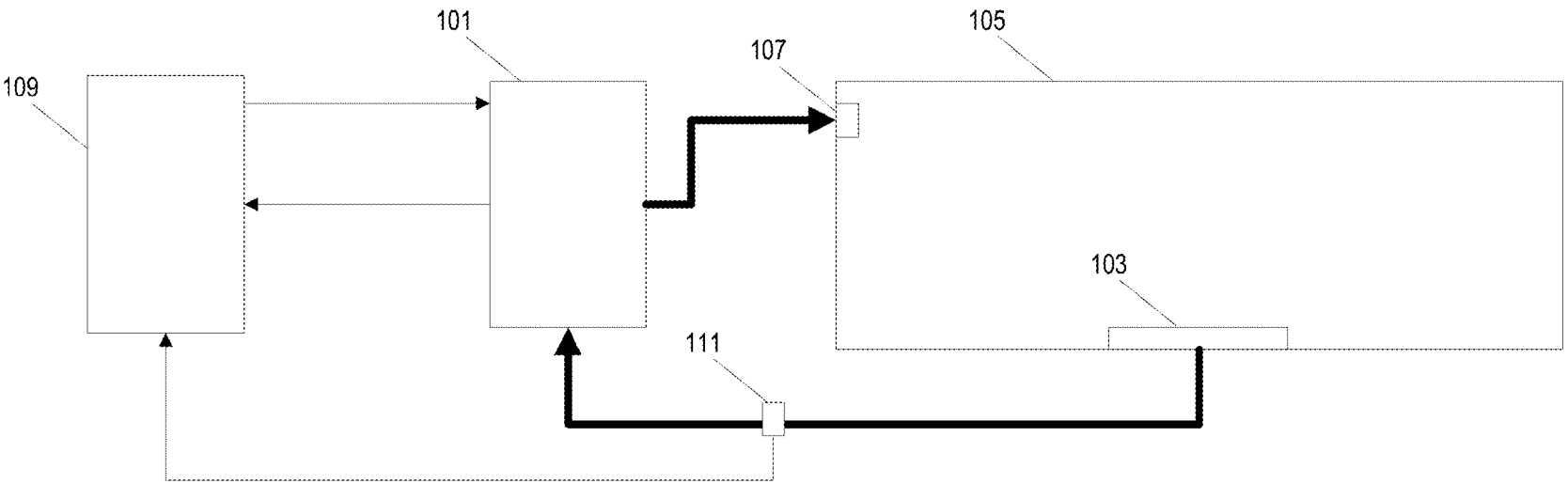
FIG. 1 is a block diagram of the pump monitoring system of one embodiment.

An SVRS (Suction Valve Release System) is integrated into a pool or spa system to detect a body entrapment in the drain of a pool or spa system and to shut off the motor in time to prevent fatal events. FIG. 1 illustrates one example of an SVRS or pump monitoring system for a variable speed pump used in a pool. The pump 101 draws water from the drain 103 of a pool 105. Water is pumped back into the pool through a valve (or head) 107. A controller 109 provides control signals to the pump 101 to control the operation of the pump 101 including the speed of a pump motor. The controller 109 also receives sensed signals from the pump 101.

For example, in some constructions, the controller 109 regulates the speed of the pump motor by controlling a voltage provided to the motor of the pump 101. The controller 109 also monitors the current of the pump motor and, as such, is able to calculate the power of the pump motor.

In some systems, sensors are positioned inside the pump 101 or at other locations within the pump system. For example, as illustrated in FIG. 1, a water velocity sensor 111 is positioned along the pipe from the drain 103 to the pump 101. The sensor 111 directly measures the velocity of water moving through the pump system and provides a signal indicative of the velocity to the controller 109.

In some constructions, the controller 109 includes an internal processor and memory. The memory stores software instructions that, when executed by the processor, cause the controller to perform various operations as described below. In other constructions, the controller 109 can be implemented, for example, as an application specific integrated circuit (ASIC). Furthermore, although the controller 109 illustrated in FIG. 1 is separate from the pump 101, in some constructions, the controller 109 may be integrated into the same housing as the pump 101.

In pump systems that include a variable speed pump motor, the power draw of the system changes as the speed changes. Therefore, entrapment events cannot always be accurately detected by comparing a power value to a static threshold. The system described below determines a Load Coefficient that is substantially independent of speed, but directly related to a blockage of the input to the pump system (e.g., the pool/spa drain). In some embodiments, the Load Coefficient is calculated based on geometric, electrical, or mechanical properties or ratios that, under normal operating conditions, generally hold constant at varying speeds. For example, as discussed in detail below (see, e.g., equation [14]), the Load Coefficient may be calculated as a ratio of the power of the pump motor relative to the velocity of the water moving through the pump.

Three methods are proposed to detect entrapment events. Two of these methods are based on the load coefficient. The third method ensures detection of entrapment during speed changes and prevents the pump from running when the power is too low to reliably detect entrapment events while also detecting entrapment events at during steady speeds. All three methods can be implemented in a single system and operate at the same time. Alternatively, pump monitoring systems can be implemented that include only one or two of the methods described below.

The first method of entrapment detection is referred to below as the Differential method. The Differential method filters the input signal (i.e., the pump load coefficient). The latest filtered signal is subtracted from a stored filtered signal that is M samples in the past. The difference is compared to a differential threshold ("DiffTripLevel"). If the differential signal drops below the differential threshold for N consecutive periods then an entrapments is declared.

The second method of entrapment detection is called the Floating Level method. The input signal is filtered and the filtered signal is compared to a slower filtered signal (the "Floating Level") which is multiplied by a percentage (lower than 1, e.g., 0.93). For example, if the input signal is filtered at a 0.7 sec time constant, the Floating Level may be determined by filtering the input signal at a 5 seconds time constant. If the filtered signal drops below the Floating Level for N consecutive periods then an entrapment is declared.

Although, theoretically, the Differential and Floating methods could be implemented based on power as the input signal, these methods would lead to problems of accuracy and may generate false entrapment detections. For example, while the Differential method based on power as an input signal detects an entrapment quickly, the Differential method fails to detect entrapment events at lower power/speed levels. This is because lower power/speed levels create lower differential levels.

The third method is not based primarily on the Pump Load Coefficient as described herein. Instead, the third method is the Current/Torque method. With this method a minimum speed versus current (q-axis current) profile is defined. If the filtered current (q-axis current), is less than the current profile for N consecutive periods, an entrapment is declared. This method also ensures correct operation of the pump, that is there is enough flow for a given speed, there is not significant obstruction in the plumbing system and power draw by the pump does not drop below reasonable operating limits.

The concept behind the current profile is defined as in the following. The motor output power is defined as $$P_{mo}=T\omega \quad [1]$$

Since the water velocity is proportional to the motor speed, the pump output power can be written as $$P_{po}=K\omega^2 \quad [2]$$

The power input and output relationship is $$P_{po}=\eta_p P_{mo} \quad [3]$$

$$P_{mo}=\eta_m P_{mi} \quad [4]$$

$$P_{mi}=\frac{P_{mo}}{\eta_m}=\frac{P_{po}}{\eta_m\eta_p} \quad [5]$$

$$P_{mi}=\frac{T\omega}{\eta_m}=\frac{K\omega^3}{\eta_m\eta_p} \quad [6]$$

Torque equality is derived from power equality as $$T=\frac{K}{\eta_{eff}}\omega^2 \quad [7]$$

where $P_{mo}$ is motor output power [W], $P_{mi}$ is motor input power [W], $P_{po}$ is pump output power [W], $\omega$ is motor mechanical speed [rad/s], $\eta_m$ is the efficiency of the motor, $\eta_p$ is the efficiency of the pump, T is torque [N−m], K is the pump load coefficient (which can be speed dependent) similar to the one in equation [13], below. Since the motor torque is $$T=K_t i_q \quad [8]$$

where $K_t$ is a constant. Current profile can be defined as $$i_{q\text{-}threshold}=C\omega^2 \quad [9]$$

where C is a coefficient and $i_{q\text{-}threshold}$ is quadrature axis (q-axis) current threshold. If the speed dependency of C is taken into account, the current versus speed profile will be a look up table.

Since the Floating Level method establishes a float level and detects the Load Coefficient drop against the steady state float level, it provides no accurate indication of entrapment events during speed changes and, therefore, can be disabled during speed changes. The Differential method and Current/Torque methods stay active during speed changes and detect entrapment events. With the Differential method, a single speed ramp rate and a differential limit can be utilized to allow the method to accurately detect entrapment events without nuisance trips caused by power level changes due to speed changes and other, non-dangerous partial entrapment events.

Figure 2:
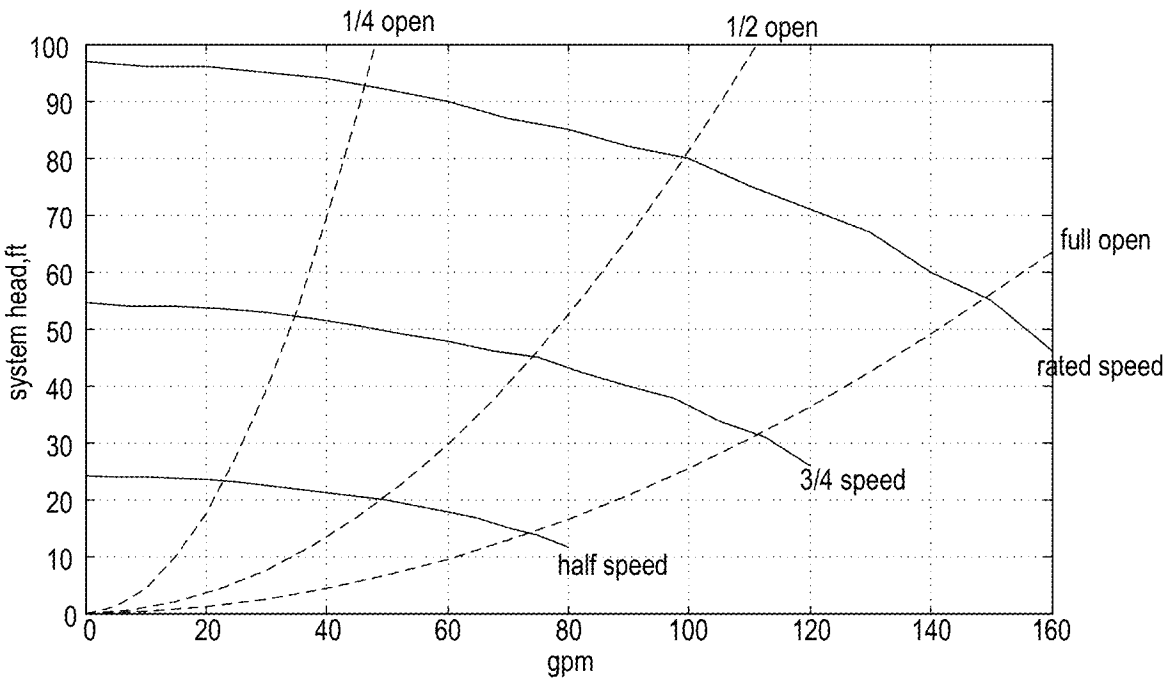
FIG. 2 is a graph of system load curves for a pump system.

FIG. 2 illustrates examples of pump system curves for a pump system at various speed settings and with various degrees of input obstruction. The Load Coefficient value is derived from pump system curves such as these. In FIG. 2, the solid lines represent the pump curves for various speeds. The rated speed curve can be obtained from the manufacturer of the pump and the family of speed curves can be derived using the pump affinity laws. In particular:

$$\frac{Q_1}{Q_2}\propto\left(\frac{rpm_1}{rpm_2}\right) \text{ and } \frac{h_1}{h_2}\propto\left(\frac{rpm_1}{rpm_2}\right)^2 \quad [10]$$

where Q is the flow rate (gpm) and h is the head pressure (ft). The pump system curves of FIG. 2 are modeled for the Sta-Rite P6E6HL pump motor system.

The dotted lines represent the system load curves for different valve openings. For a given valve opening (and for a given system), the head pressure varies as a square of the water velocity as represented by the equation:

$$h=K_pV^2 \quad [11]$$

The power of the motor system (either input or output power of the motor) is proportional to the head pressure and the water velocity as represented by the equation:

$$P=\frac{hV}{\eta_{eff}} \quad [12]$$

where $n_{eff}$ is a value indicative of the efficiency of both the pump and the motor. Therefore, motor power is proportional to the water velocity cubed, as indicated by the equation:

$$P=\frac{K_p}{\eta_{eff}}V^3=K_{lc}V^3 \quad [13]$$

The Load Coefficient $L_{lc}$ is determined by dividing the power of the motor by the velocity of the water cubed as expressed by the following equation:

$$K_{lc}=\frac{P}{V^3} \quad [14]$$

It is to be known that even though the theory has been derived around the water velocity, the motor speed can be used, in equation [14], instead of water velocity, due to the fact that the motor speed is proportional to the water velocity.

The Load Coefficient $K_{lc}$ varies as a function of the valve opening. Based on the data from the pump system curves of FIG. 2, the Load Coefficient varies from one to seven as the valve opening changes from full open to ¼ open. The seven fold change in Load Coefficient is a large enough signal to use for entrapment detection. The Load Coefficient calculated by this method changes slightly with speed; however the change is not great enough compared to the change due to entrapment events to cause a false detection of an entrapment due to speed changes.

Figure 3:
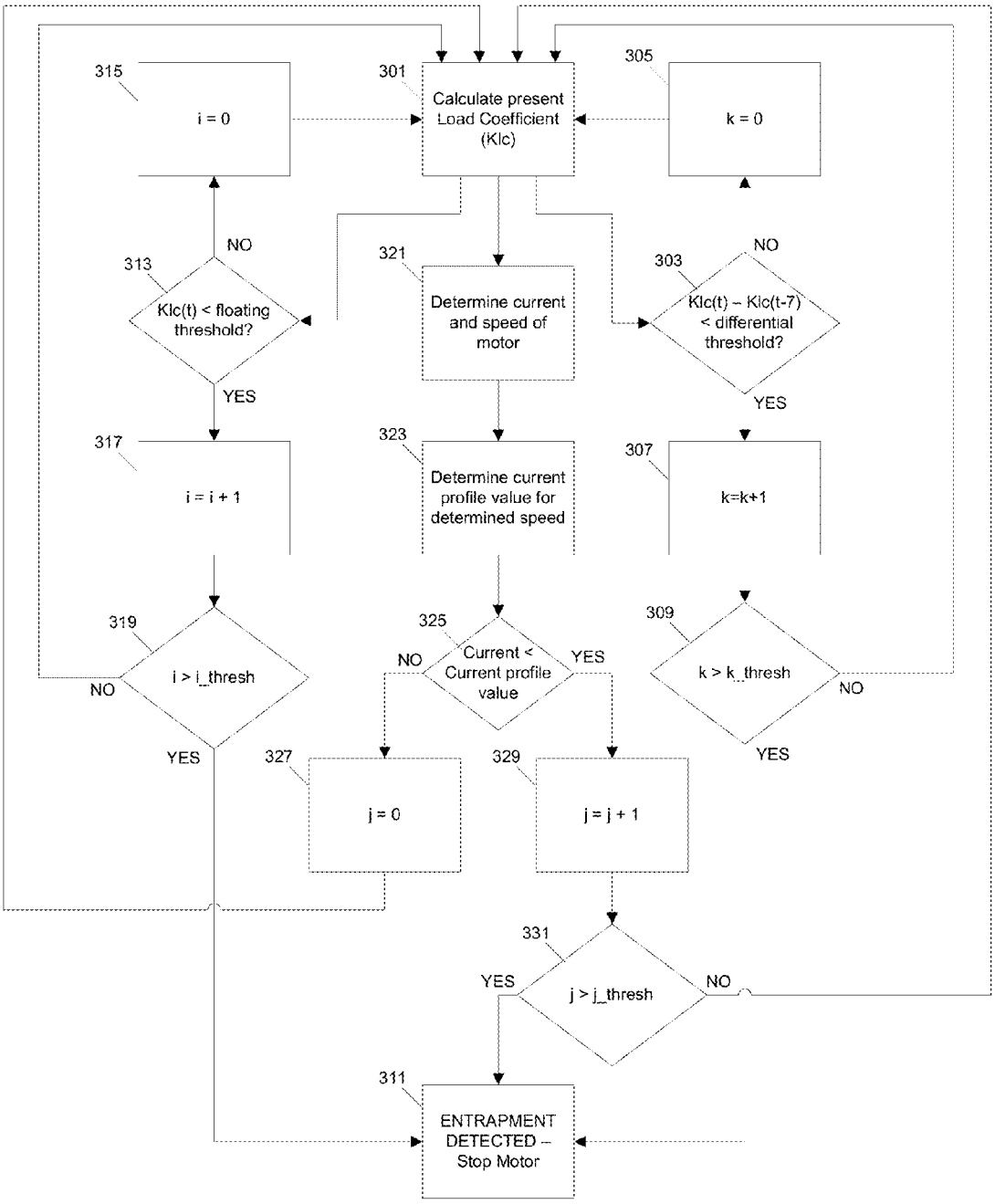
FIG. 3 is a flow-chart illustrating a method of detecting entrapment events in a pump system using a Load Coefficient.

FIG. 3 illustrates a method of detecting an entrapment event using the three methods described above and the Load Coefficient value. The system begins by calculating the present Load Coefficient (step 301). The system then performs all three of the entrapment detection methods concurrently. However, as described above, other system constructions may only implement one or two of the three detection methods. Furthermore, in some systems, the three methods are executed serially instead of in parallel as illustrated in FIG. 3.

In the Differential method, the system calculates the difference between the present Load Coefficient $K_{lc}(t)$ and a previous Load Coefficient—in this example, a Load Coefficient calculated seven cycles earlier $K_{lc}(t-7)$. The difference is compared to a differential threshold (step 303). Because an entrapment event will cause the load coefficient to decrease, the difference of $K_{lc}(t)-K_{lc}(t-7)$ will result in a negative value during an entrapment event. Therefore, the differential threshold itself has a negative value.

If the difference is more than the differential threshold (i.e., a positive value or a negative value with a lesser magnitude than the differential threshold), a first counter (k) is reset to zero (step 305) and the system concludes that there is no entrapment event. However, if the difference is less than the differential threshold (i.e., a negative value with a higher magnitude than the differential threshold), the system increments a counter (step 307). If the difference remains below the differential threshold for a defined number of cycles (k_thresh) (step 309), the system concludes that an entrapment event has occurred and stops the pump motor (step 311).

In the Floating method, the system compares the present Load Coefficient to a floating threshold (step 313). If the Load Coefficient is above the threshold, the system resets a second counter (step 315) and concludes that there is no entrapment. However, if the Load Coefficient is less than the floating threshold for a defined number of sampling cycles (steps 317 and 319), the system concludes that an entrapment event has occurred and stops the pump motor (step 311).

Lastly, the system performs the current/torque method for monitoring entrapment conditions. The system determines a speed and current of the motor (step 321) and accesses a current profile (step 323). The current profile defines current profile values and corresponding speed values. If the actual current is above the current profile value corresponding to the determined speed (step 325), then the system concludes that there is no entrapment (step 327). However, if the actual current is below the current profile value and remains there for a defined number of sampling cycles (steps 329 and 331), then the system concludes that an entrapment event has occurred or it is not safe to run the pump and stops the pump motor (step 311).

The Load Coefficient as described above is based in fluid dynamics. The head pressure of the pump system can be described by adding several variables that each impact the water pressure of the system:

$$h_{total}=h_{height}+h_{pipe}+\Sigma h_{elbow}+\Sigma h_{valve} \quad [15]$$

where $h_{height}$ is the height of the pump above the water level, $h_{pipe}$ is the head pressure loss due to the straight pipe, $h_{elbow}$ is the head pressure loss due to each elbow connection in the pipe system, and $h_{valve}$ is the head pressure loss due to each valve in the system. Other terms of the Bernoulli equation are assumed to be zero (e.g., the change in velocity of the water).

Figure 4:
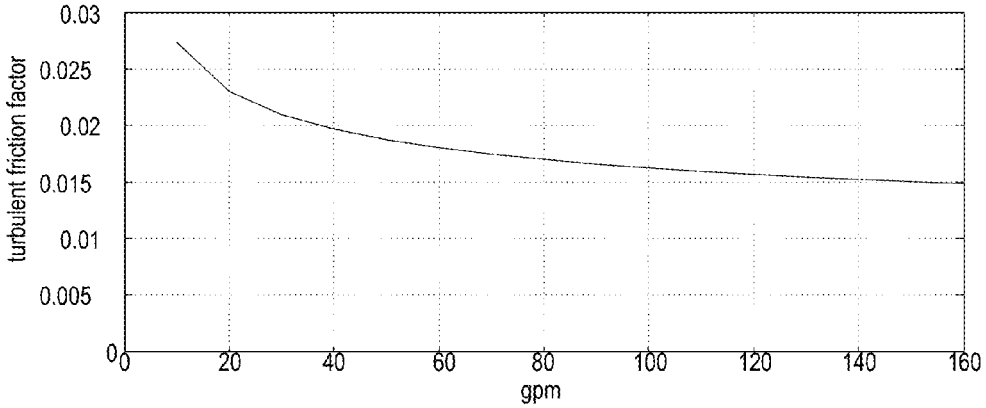
FIG. 4 is a graph of the friction factor for a pump system.

$h_{pipe}$ is defined by the following equations:

$$h_{pipe}=f\frac{L_{pipe}}{2Dg}V^2 \quad [16]$$

where f is a friction factor, $L_{pipe}$ is the length of the pipe, D is diameter of the pipe, g is the acceleration due to gravity, and v is the velocity of the fluid in the pipe. The friction factor a function of whether the flow through the pipe is laminar or turbulent. The Reynolds number is used to determine if the flow is laminar ($Re_d<2000$) or turbulent ($Re_d>4000$) and is defined as follows:

$$Re_d=\frac{\rho D}{\mu}V \quad [17]$$

where ρ is the density of water and μ is the viscosity of water. In order to have laminar flow for a 2 inch pip, the flow rate would have to be less than one gallon-per-minute. The friction factor for a smooth walled pipe can be approximated by:

$$f = \left(1.8\log\left(\frac{Re_d}{6.9}\right)\right)^{-2} \quad [18]$$

which illustrated by the graph of FIG. 4. As illustrated, there is very little change in the friction factor across the operating range of a pool pump and, therefore, the system can assume that the friction factor is constant (f=0.0155). As such, $h_{pipe}$ is assumed to be proportional to the velocity of the water square.

$$h_{pipe} = 0.0155\frac{L_{pipe}}{2Dg}V^2 \quad [19]$$

The pressure loss due to the 90-degree elbows or the valves in the system is calculated using the following formula:

$$h_{elbow} = h_{valve} = f\frac{L_{eq}}{2Dg}V^2 = \frac{K}{2g}V^2 \quad [20]$$

where K=0.39 for a two-inch, 90-degree regular radius, flanged elbow and $K_{open}$=8.5 for an open two-inch flanged ball (globe) valve. The ratio of $K_{open}$/K for a ball valve is shown in the following table

TABLE 1

| Condition | Ratio $K_{open}$/K |
|---|---|
| Open | 1.0 |
| Closed, 25% | 1.5-2.0 |
| Closed, 50% | 2.0-3.0 |
| Closed, 75% | 6.0-8.0 |

FIG. 2, above, shows a graph of the sum of all of the system pressures (calculated based on Equation [21] below). As illustrated by the graph and equation [21], the system pressure is proportional to velocity squared.

$$h_{total} = h_{height} + h_{pipe} + \sum h_{elbow} + \sum h_{valve} = \frac{0.0155}{2Dg}(L_{pipe} + L_{elbowEq} + L_{valveEq})V^2 \quad [21]$$

Figure 5:
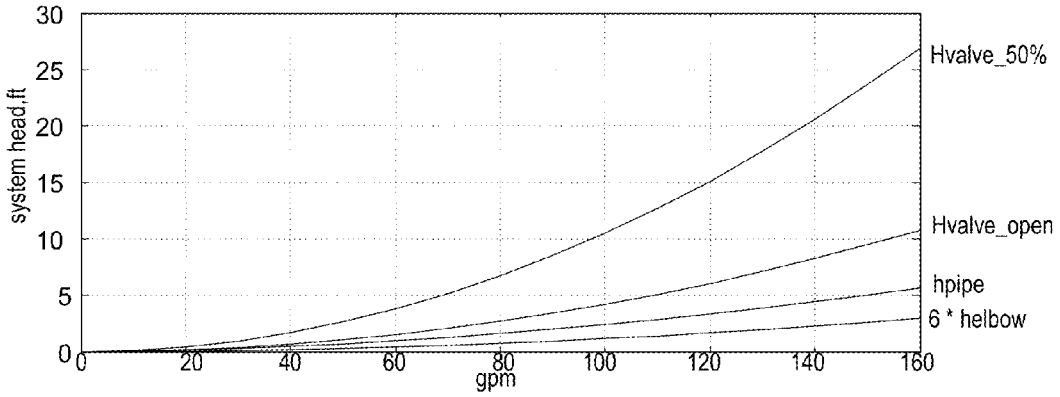
FIG. 5 is a graph of system load curves attributable to individual portions of the pump system.

FIG. 5 illustrates the individual contributions of each of the head pressure values. As illustrated in FIG. 5, the greatest contributor to head pressure is the valve opening.

Comparing equation [21] to equations [11] and [13] shows:

$$K_p = \frac{0.0155}{2Dg}(L_{pipe} + L_{elbowEq} + L_{valveEq}) \quad [22]$$

$$\text{where } K_{lc} = \frac{K_p}{\eta_{eff}}$$

As such, the Load Coefficient is a function of the system equivalent length, the pump and motor efficiency, and the pipe diameter where the dominate L is the $L_{valveEq}$. As such, the Load Coefficient is mostly proportional to the valve opening (i.e., the amount of blockage/entrapment).

Figure 6:
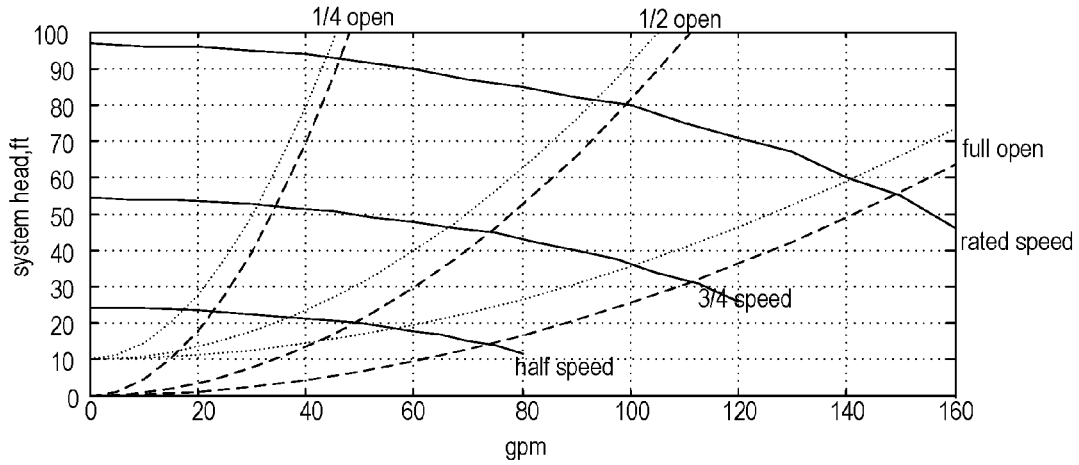
FIG. 6 is a graph illustrating changes in system curves due to pump height.
Figure 7:
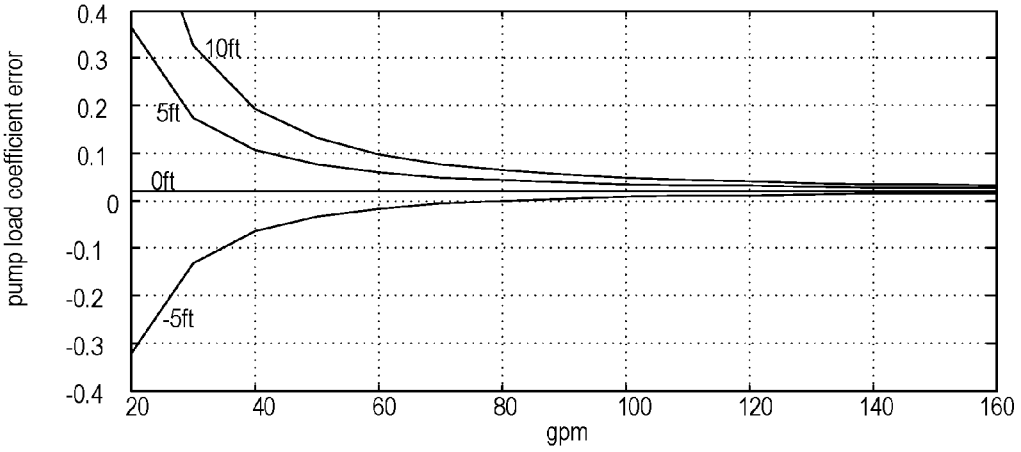
FIG. 7 is a graph of Load Coefficient errors due to variations in pump height.

The head height adds an offset to the system curve that, if not accounted for in the Load Coefficient calculation, results in a Load Coefficient that changes as a function of speed. The graph of FIG. 6 shows two system curves for a pump—one with a 10 foot head height and the other with a zero foot head height. As illustrated by the graph of FIG. 7, the Load Coefficient error increases as the height of the pump varies from zero.

Although the change in Load Coefficient as a function of speed varies less than the change in power as a function of speed, it is possible to eliminate any changes in the Load Coefficient due to changes in speed. To accomplish this, the controller of the system must account for the height of the system. The height can be determined through a calibration process using the following equations:

$$h_{total} = h_{height} + K_p V^2 \quad [23]$$

Substituting into equations [24]-[26], $$P = \frac{1}{\eta_{eff}}(h_{height} + K_p V^2)V = h_{heightEq}V + K_{lc}V^3 \quad [24]$$

$$K_{lc} = \frac{P - h_{heightEq}V}{V^3} \quad [25]$$

To find the $h_{heightEq}$, the power is measured at two speeds, $V_{HS}$ and $V_{LS}$. As such:

$$K_{lc} = \frac{P_{HS} - h_{heightEq}V_{HS}}{V_{HS}^3} = \frac{P_{LS} - h_{heightEq}V_{LS}}{V_{LS}^3} \quad [26]$$

and, solving for $h_{heightEq}$:

$$h_{heightEq} = \frac{\left(\frac{V_{HS}}{V_{LS}}\right)^3 P_{LS} - P_{HS}}{\left(\frac{V_{HS}}{V_{LS}}\right)^3 V_{LS} - V_{HS}} \quad [27]$$

For example, if $V_{HS}$=1 pu and $V_{LS}$=¼ pu then, $$h_{heightEq} = \frac{64P_{LS} - P_{HS}}{64V_{LS} - V_{HS}} = \frac{1}{15}(64P_{LS} - P_{HS}) \quad [28]$$

A Load Coefficient that accounts for pump height can be found using equation [27] to find the pump height through the high-speed/low-speed calibration process and then substituting the result into equation [25].

Thus, the invention provides, among other things, systems and methods for detecting an entrapment event based on Load Coefficient and a current/torque profile. As outlined above, system calibration can be performed in order to alleviate the variation expected in Load Coefficient at different speeds due to head height difference. However, Load Coefficient can also be used in entrapment detection without calibration for head height as long as an appropriate speed ramp and trip threshold are selected due to the relatively constant value of the Load Coefficient due to speed as compared to the change in Load Coefficient due to entrapment events. Various features and advantages of the invention are set forth in the following claims.

What is claimed is:

1. A pump monitoring system, comprising a controller configured to:

determine a first value for motor power, the first value for motor power indicative of pump performance;

determine a second value, the second value indicative of at least one selected from the group consisting of a liquid velocity and a motor speed;

calculate a pump load coefficient to produce a calculated pump load coefficient, the calculated pump load coefficient based at least in part on the first value and the second value;

filter the calculated pump load coefficient using a first time constant to produce a filtered pump load coefficient;

filter the calculated pump load coefficient using a second time constant to produce a filtered floating threshold value, the second time constant being greater than the first time constant;

compare the filtered pump load coefficient with the filtered floating threshold value;

detect a blockage of a drain based on a comparison of the filtered pump load coefficient and the filtered floating threshold value;

adjust an operation of the pump based on the detected blockage, and wherein the controller is further configured to calculate a difference between the calculated pump load coefficient for a first cycle and a previous pump load coefficient calculated for a previous cycle a first defined number of cycles before the first cycle, the first defined number of cycles being greater than one, and detect a blockage of the drain when the difference traverses a threshold for a second defined number of cycles.

2. The pump monitoring system of claim 1, wherein the pump load coefficient is calculated based on the equation:

$$K_{lc}=P/V^3$$

where $K_{lc}$ is the pump load coefficient, P is the first value indicative of the motor power of the pump, and V is the second value indicative of liquid velocity.

3. The pump monitoring system of claim 1, wherein the value of the pump load coefficient is calculated based at least in part on a head pressure of the pump system.

4. The pump monitoring system of claim 1, wherein the controller is calibrated for a specific pump system to account for the head pressure of the pump system.

5. The pump monitoring system of claim 4, wherein the controller is configured to calculate the pump load coefficient based on the equation:

$$K_{lc} = \frac{P - h_{heightEq}V}{V^3}$$

where $K_{lc}$ is the pump load coefficient, P is the first value indicative of the motor power of the pump, V is the second value indicative of liquid velocity, and $h_{heighteq}$ is a calibrated constant determined for a specific pump system.

6. The pump monitoring system of claim 5, wherein the calibrated constant is experimentally determined from an equality of the pump load coefficients for at least two operating points by determining a third value indicative of motor power for the specific pump system at a first water speed, determining a fourth value indicative of motor power for the specific pump system at a second liquid speed, and solving for $h_{heighteq}$.

7. The pump monitoring system of claim 1, wherein the controller is further configured to detect a blockage of the drain by determining a difference between the calculated pump load coefficient and a previously calculated pump load coefficient; and comparing the difference to a threshold.

8. The pump monitoring system of claim 7, wherein the previously calculated pump load coefficient is not the immediately previously pump load coefficient calculated by the controller.

9. The pump monitoring system of claim 1, wherein the controller is further configured to determine a current of the motor;

determine a speed of the motor;

determine, based on a look up table stored in a memory, an expected current corresponding to the determined speed; and detect a blockage of the drain when the current of the motor is less than the expected current corresponding to the determined speed for a second defined number of cycles.

10. The pump monitoring system of claim 1, wherein the controller includes a processor and a memory, the memory storing instructions that, when executed by the processor, cause the processor to detect a blockage of the drain.

11. The pump monitoring system of claim 1, wherein the liquid holding tank includes a swimming pool.

12. The pump monitoring system of claim 1, wherein, the second defined number of cycles is less than or equal to the first defined number of cycles.

13. A method of monitoring a pump for a blockage condition, the method comprising:

determining a value indicative of pump performance;

calculating a pump load coefficient for a first cycle to produce a first calculated pump load coefficient, the calculated pump load coefficient based at least in part on the value indicative of pump performance, wherein a value of the pump load coefficient is calculated based on a ratio of motor power to water velocity and is indicative of a blockage of a drain in a liquid holding tank, the drain being coupled to an input of the pump;

calculating a difference between the first calculated pump load coefficient and a previous pump load coefficient calculated for a previous cycle a first defined number of cycles before the first cycle, the first defined number of cycles being greater than one; and detecting a blockage of the drain when the difference is less than a threshold for a second defined number of cycles, the threshold being less than or equal to zero; and adjusting an operation of the pump based on the detected blockage.

14. The method of claim 13, wherein the second defined number of cycles is less than or equal to the first defined number of cycles.

15. A method of monitoring a pump for a blockage condition, the method comprising:

determining a first value for motor power, the first value indicative of pump performance;

determining a second value, the second value indicative of at least one selected from the group consisting of a liquid velocity and a motor speed;

calculating a pump load coefficient to produce a calculated pump load coefficient, the calculated pump load coefficient based at least in part on the first value and the second value;

filtering the calculated pump load coefficient using a first time constant to produce a filtered pump load coefficient;

filtering the calculated pump load coefficient using a second time constant to produce a filtered floating threshold value, the second time constant being greater than the first time constant;

comparing the filtered pump load coefficient with the filtered floating threshold value;

detecting a blockage of a drain based on a comparison of the filtered pump load coefficient and the filtered floating threshold value;

calculating a difference between the calculated pump load coefficient for a first cycle and a previous pump load coefficient calculated for a previous cycle a first defined number of cycles before the first cycle, the first defined number of cycles being greater than one; and detecting a blockage of the drain when the difference traverses a threshold for a second defined number of cycles, the threshold being less than or equal to zero; and adjusting an operation of the pump based on the detected blockage.

16. The method of claim 15, wherein the pump load coefficient is calculated based on the equation:

$$K_{lc}=P/V^3$$

where $K_{lc}$ is the pump load coefficient, P is the value indicative of the motor power of the pump, and V is the second value indicative of liquid velocity.

17. The method of claim 15, wherein the value of the pump load coefficient is calculated based at least in part on a head pressure of the pump system.

18. The method of claim 15, wherein the pump load coefficient is calculated based on the equation:

$$K_{lc}=(P-h_{heighteq}*V)/V^3$$

where $K_{lc}$ is the pump load coefficient, P is the value indicative of the motor power of the pump, V is the value indicative of at least one selected from the group consisting of liquid velocity and motor speed of the pump, and $h_{heighteq}$ is a calibrated constant determined for a specific pump system.

19. The method of claim 18, further comprising experimentally determining the calibrated constant from an equality of the pump load coefficients for at least two operating points by determining a third value indicative of motor power for the specific pump system at a first water velocity, determining a fourth value indicative of motor power for the specific pump system at a second liquid velocity, and solving for $h_{heighteq}$.

20. The method of claim 15, wherein the blockage of the drain is determined by determining a difference between the calculated pump load coefficient and a previously calculated pump load coefficient; and comparing the difference to a threshold.

21. The method of claim 20, wherein the previously calculated pump load coefficient is not the immediately previously pump load coefficient calculated by the controller.

22. The method of claim 15, further comprising determining a current of the motor;

determining a speed of the motor;

determining, based on a look up table stored in a memory, an expected current corresponding to the determined speed; and detecting a blockage of the drain when the current of the motor is less than the expected current corresponding to the determined speed for a second defined number of cycles.

23. The method of claim 15, wherein the second defined number of cycles is less than or equal to the first defined number of cycles.

* * * * *